US005251352A

United States Patent [19]

Cullison

[11] Patent Number: 5,251,352

[45] Date of Patent: Oct. 12, 1993

[54] SEVEN WAY COMBINATION TOOL

[76] Inventor: Jesse L. Cullison, 2515 S. Union Rd., Dayton, Ohio 45418

[21] Appl. No.: 868,879

[22] Filed: Apr. 16, 1992

[51] Int. Cl.[5] ..... B44C 7/00

[52] U.S. Cl. ..... 7/105; 7/165; 30/169; 81/440

[58] Field of Search ..... 7/105, 165, 167, 168; 81/440; 30/169

[56] References Cited

U.S. PATENT DOCUMENTS

| | | | |
|---|---|---|---|
| 960,624 | 6/1910 | Compton | 7/105 X |
| 2,213,071 | 8/1940 | Keller | 7/105 X |
| 2,839,110 | 6/1958 | Carpenter | 7/105 X |
| 3,774,252 | 11/1973 | Cantales | 7/105 |
| 5,063,627 | 11/1991 | Marra | 7/105 |

*Primary Examiner*—James G. Smith
*Attorney, Agent, or Firm*—Joseph Patrick Burke

[57] ABSTRACT

The present disclosure is directed to a seven-way combination tool allowing for separate use of each of seven different functional portions of the tool and having a central blade, with upper and lower surfaces one of which has a concave surface and its blade tip is beveled at the end opposite the handle. The tool handle has upper and lower portions, both of which are independently rotatable 360° and each of which has a polygonal opening to accommodate polygonal shafted screwdrivers of different head types. At the tip of the central blade are located tip angle edge portions of different areas. One of which is located adjacent to the concave surface of the blade.

10 Claims, 2 Drawing Sheets

10
11
11'
11"
12
13
13'
14
14'
16
16'
18
18'
19
21
30
32
36
37
38

SEVEN WAY COMBINATION TOOL

BRIEF DESCRIPTION OF THE INVENTION

The present invention is directed to a seven way combination tool allowing for separate use of each functional portion and having a central blade, with upper and lower surfaces one of which has a concave surface and whose blade tip is beveled at the end opposite the handle. The tool handle has upper and lower portions, both of which are independently rotatable 360°, and each of which has a polygonal opening to accommodate polygonal shafted screw drivers of different head types.

At the tip of the blade, are located tip angle edge portions of different areas, one of which is located adjacent to the concave surface of the blade.

BACKGROUND OF THE INVENTION AND PRIOR ART

A single combination tool for painters and glazers which enables the user to conduct a plurality of operations associated with painting and glazing has been desired for some time. These procedures are: cleaning a paint roller, scraping old paint, setting glazing tips, cleaning cracks, working putty, opening paint cans (removing lids), and removing flat head and Phillips screws, e.g., to remove light switch plates.

There have been many attempts in prior art devices to provide: combination painters' and related industrial artists' combination tools and implements. However, none of these combination tools accomplishes the seven way function of the present invention with the structural characteristics which the present invention possesses.

U.S. Pat. No. 429,515 issued to M. Fred is directed to a painter's implement which is a three way combination tool in essence serving as a putty knife, a screw adapted to serve as a holder for the painter when screwed into a wall or other place, and a paint pot hanger.

U.S. Pat. No. 699,207 issued to S. A. Moe relates to a combination tool having three separate functions, viz., that of a putty knife (1), a pair of claws (7) which are lockable in position, and a screwdriver or similar instrument (14). As will be noted from the Moe patent disclosure, the basic portions of the handle are not reversible for positioning a tool component in position for independent use.

U.S. Pat. No. 896,746 issued to W. B. McCarty is directed to a combination tool having basically four functions, viz., a pair of wrenches (13), wire cutters (4, 5) knives (8) and screwdrivers (18, 19 ). The wrenches tend to accommodate nuts of different sizes. The McCarty patent also states that the handle member (11) not only serves the function of closing the chamber (7) over the knife blade, but also serves the additional function of a separate handle when the jaws (4, 5) are to be opened or closed during the use of and manipulation of the device as a pair of pliers or the like.

U.S. Pat. No. 1,331,204 issued to O. H. Lay is directed to a combination tool that embodies elements whereby the tool may be used as a lace leather cutter, edging knife, rivet set, rivet header, screwdriver and punch. In the Lay combination tool any of the tool portions is reversible and pivotal about a pin which is movable within a slot in the handle portion of the tool.

U.S. Pat. No. 2,559,993 issued to H. P. Parrigin, et al, is directed to a tool having a plurality of blades pivotally attached to a handle portion. This patent does not show handle portions which are reversible for positioning tool components in various positions of independent use separate from one another.

U.S. Pat. No. 2,839,110 issued to H. C. Carpenter is directed to a combination glazing tool containing a putty knife in the handle of which are mounted various forms of tools necessary for use in glazing and also containing a nail-setting tool which can be extended and turned to be automatically locked in a position at a right angle with respect to the handle so as to permit it to be readily applied at one end to a nail leaving the other end free to be stroked by a hammer while setting the nail. The Carpenter folding blade sheathed nail set does not have a handle having reversible upper and lower portions, each permitting separate use of tool components mounted therein in combination with a central blade having the various separate functions of the combination tool of this invention.

U.S. Pat. No. 3,186,009 issued to R. P. Simmons is directed to a multi-purpose hand tool having four small foldable hand tools to turn screw fasteners and punch or counter sink holes and the like, which small individual hand tools are mounted circumferentially in four grooves positioned around the outer periphery of the handle. In addition the Simmons multi-purpose hand tool contains a centrally located screwdriver element (59). Each of the individual peripherally mounted components are movable to a position normal to the long axis of the handle.

DETAILED DESCRIPTION OF THE INVENTION

As will be noted from the drawings, the seven way combination tool (10) contains a central blade (11) which is metal, preferably steel, and preferably full tang, viz., the blade extends throughout the entire portion of the handles. This exposed central blade (11) has an upper portion (11') and lower portion (11"). Central blade (11) has a concave edge surface

Figures 1, 2, 3, 4, 5:
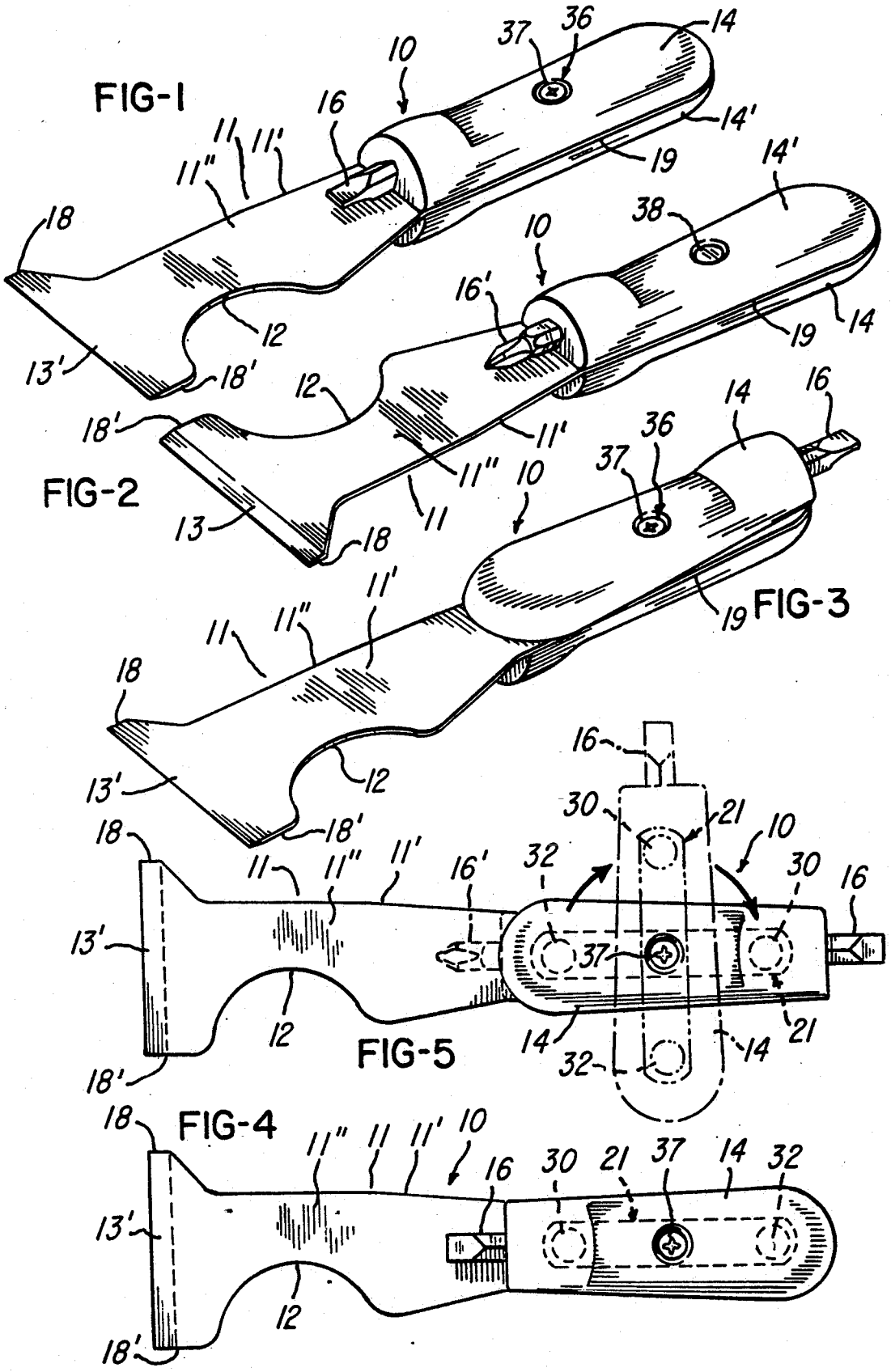
FIG. 1 is a perspective view of the tool of this invention showing the top front and one side portion.
FIG. 2 is a perspective view of the same tool showing the bottom front and the other side portion thereof.
FIG. 3 is a perspective view similar to that of FIG. 1 but showing the rotation of this screwdriver head located in the upper handle portion having been rotated 180° to relocate its screwdriver head in position for independent and separate use.
FIG. 4 is a top plan view of the combination tool of this invention partially in phantom line.
FIG. 5 is a top plan view as in FIG. 4 but showing 90° and 180° rotation in phantom line of the upper handle portion with its appropriate screwdriver head.

(12) which serves as a roller cleaner, viz., to remove paint from paint rollers. The central blade also has a beveled tip portion (13) useful as a scraper located at the blade end opposite the handle (FIG. 2). The reverse side of beveled tip (13) is flat and useful as a putty knife (13').

Figure 7:
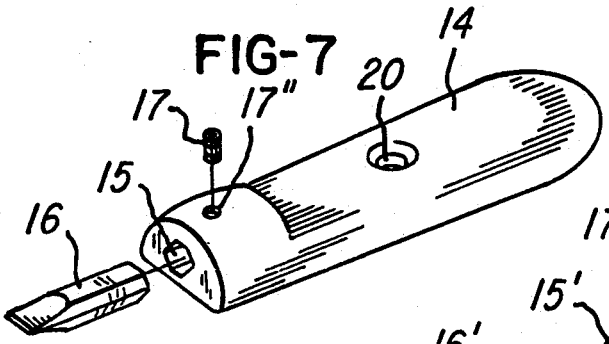
FIG. 7 is a perspective exploded view of one handle member with its respective retainer means and containing a flat head screw head positioned in its respective polygonal opening in the handle.
Figure 8:
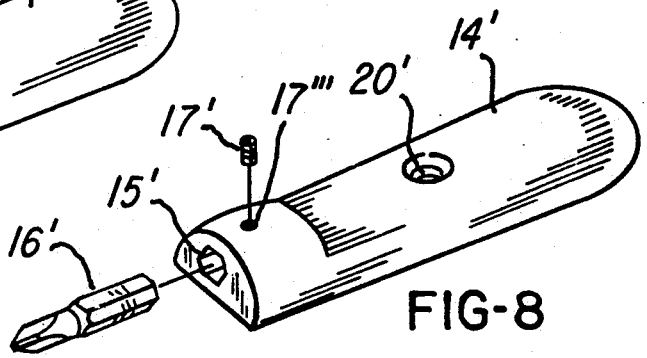
FIG. 8 is a perspective exploded view of the other handle member with its respective retaining means for holding a screwdriver head of a different configuration within its respective polygonal opening.

The handle is comprised of two independently rotatable portions the rotatable upper handle portion (14) and the rotatable lower handle portion (14') each of which is rotatable 360°. The upper handle portion (14) has polygonal opening (15) as shown in FIG. 7 and the lower handle portion (14') has its polygonal opening (15') as shown in FIG. 8. Polygonal shafted screwdriver (16') of one head type, e.g., Phillips, fits in polygonal opening (15') in the lower handle portion. Corresponding polygonal shafted screwdriver (16) having a different head type from that of (16'), e.g., flat head (slotted), fits in polygonal opening (15) in the upper handle portion. Flat head screwdriver component (16) can also be used to open paint cans.

As shown in FIGS. 7 and 8, retaining means (17) holds screwdriver (16) in place within rotatable upper handle portion (14) via opening 17" and retaining means (17') serves to hold screwdriver (16') in place within rotatable lower handle portion (14') via opening 17'''. In accordance with a preferred embodiment of this invention retaining means (17) and (17') allow for ready removal of the screwdriver heads (16) and (16'), respectively, allowing them to be replaced with either other shaped screwdriver heads or replacement with each respective type head when they are worn. Means (17, 17') can be dog point screws, pins (threaded or unthreaded), bolts, etc. When bolts are used, corresponding nuts (not shown) can be used on the inner surfaces of handle portions (14, 14').

As will be apparent from FIGS. 1 through 6, central blade (11) has a first angle tip edge portion (18) and a second angle tip edge portion (18') both of which can be used in glazing to drive home (set) glazing tips. These edge portions can also be used for cleaning cracks in wooden structures prior to paining. The second tip edge portion (18') has a larger surface areas than that of (18) and it is located adjacent to concave surface (12) of the central blade. As will be noted from FIG. 6, in accordance with a preferred embodiment of this invention the tang portion (19) of blade (11) extends within the entire length of both handle portions (14) and (14') of combination tool (10).

Handle portion (14) has an opening (20) whose axis is substantially normal to that of its polygonal opening (15). See FIG. 7. Preferably opening (20) is counter sunk. Similarly handle portion (14'), FIG. 8, has its respective opening (20') whose axis is substantially normal to that of its polygonal opening (15'). Preferably this opening (20') is counter sunk also.

The tang portion (19) of blade (11) has a centrally located opening (20") which permits it to be fixedly yet releasably secured to upper and lower handle portions (14) and (14') respectively. Located within each respective handle portion are upper and the lower leaf springs (21) and (22). Each of these leaf springs has its respective opening (23). Openings (23) are preferably centrally located in the arch portions (28) and (29) of upper and lower leaf springs (21) and (22), respectively.

Figure 6:
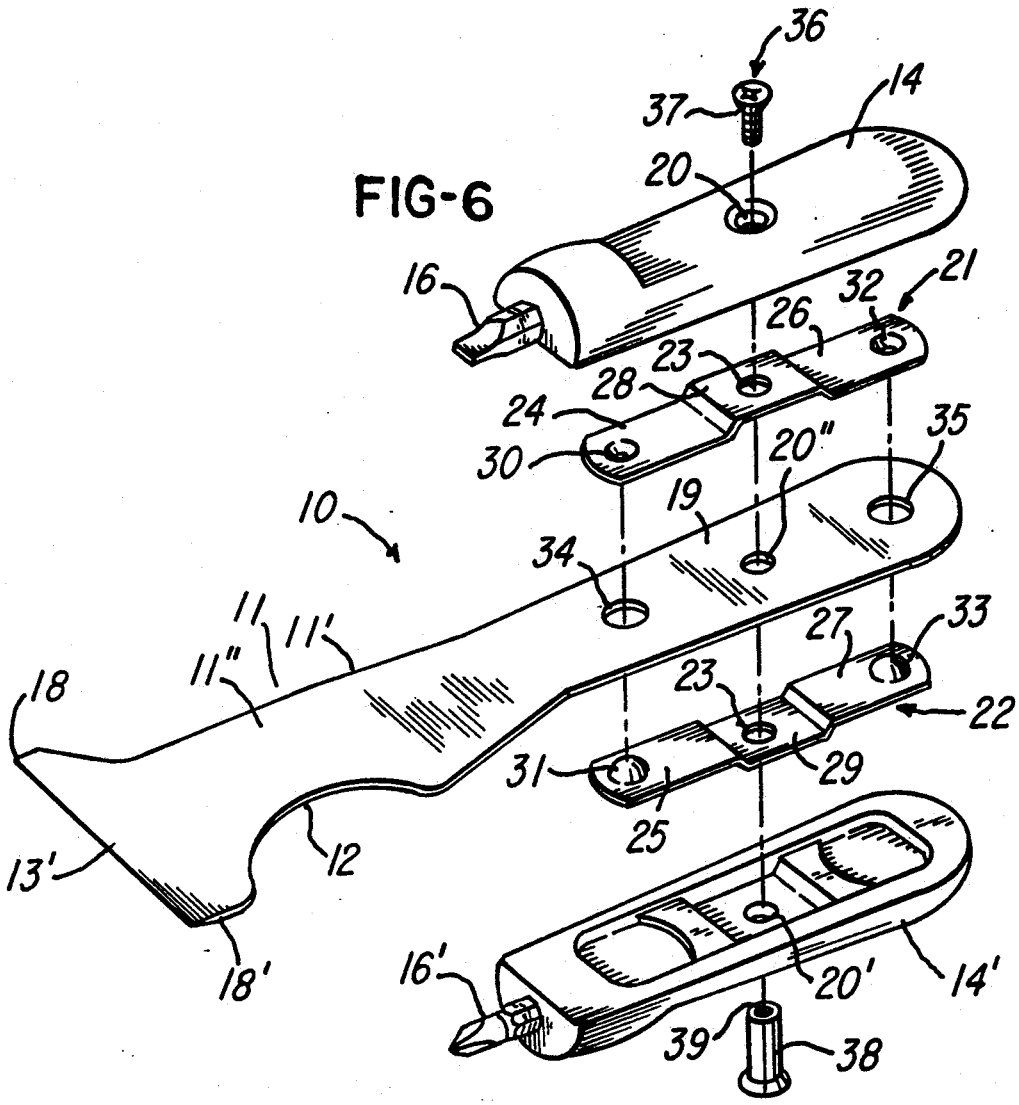
FIG. 6 is an perspective exploded view of the combination tool of this invention in its position of assembly before rotation of either the upper or lower handle members.

It will be observed particularly from FIG. 6 that upper leaf spring (21) has proximal and distal base portions (24) and (26), respectively. Similarly lower leaf springs (22) has its proximal and distal base portions (25) and (27), respectively. Finally upper leaf spring (21) has downwardly facing proximal and distal detents (30) and (32), respectively whereas lower leaf spring (22) has its upwardly facing proximal and distal detents (31) and (33), respectively.

The tang portion of the central blade has first and second end openings (34) and (35). The first end opening (34) is preferably adjacent to the tang portions proximal end whereas the second end opening (35) in the tang portion is preferably located adjacent to its distal end.

As will be noted from FIG. 6, leaf spring detents (30, 31) and (32, 33) with their convex surfaces facing one another are rotatably positioned within openings (34) and (35), respectively. thereby permitting independent rotation of both the upper and lower handle members (14) and (14'), respectively.

The entire assembly constituting seven way combination tool (10) is assembled by passing adjustable securing means (36), including upper portion (37) and lower portion (38), through respective openings (20), (23), (20''), (23) and (20') to threadably engage the threaded interior (39) of rivet (38) utilizing screw (37), preferably having a counter sunk head.

I claim:

1. A seven-way combination tool allowing for separate and independent use of each functional portion thereof comprising a central blade with upper and lower portions, the lower portion having a concave edge surface, and whose blade tip is beveled; upper and lower tool handle portions both of which are rotatable 360° independently of one another and each of which has a polygonal opening shaped to accommodate polygonal shafted screwdrivers of different head types; and tip angle edge portions of different areas located at opposite edges of the tip of said central blade, one of which is located adjacent to said concave surface edge of said blade.

2. A seven-way combination tool as in claim 1 wherein said central blade portion on the reverse side of said blade beveled tip is flat.

3. A seven-way combination tool as in claim 2 where in said tip angle edge portion adjacent to said concave surface has a larger surface area than the other tip angle edge portion.

4. A seven-way combination tool as in claim 3 wherein said polygonal openings are hexagonal.

5. A seven-way combination tool as in claim 4 wherein one of said screwdrivers is of the slotted (flat) head type.

6. A seven-way combination tool as in claim 4 wherein another of said screwdrivers is of the Phillips head type.

7. A seven-way combination tool as in claim 4 wherein each rotatable handle portion contains an opening shaped for accommodating said screwdrivers, and retaining means for holding each screwdriver in place and readily allowing removal thereof.

8. A seven-way combination tool as in claim 1 wherein each rotatable handle portion contains a leaf spring with a central opening and detents to enable rotation of each handle portion independently.

9. A seven-way combination tool as in claim 8 wherein said central blade has a tang portion containing end openings at locations permitting positioning said detents therein.

10. A seven way combination tool as in claim 9 which includes adjustable securing means to secure said handle portions and leaf springs to said central blade via central openings therein.

* * * * *